US009109567B2

(12) United States Patent
Moriya et al.

(10) Patent No.: US 9,109,567 B2
(45) Date of Patent: Aug. 18, 2015

(54) STARTER CONTROL DEVICE, STARTER CONTROL METHOD, AND ENGINE STARTING DEVICE

(75) Inventors: Kouki Moriya, Aichi-gun (JP); Jumpei Kakehi, Toyota (JP); Hasrul Sany Bin Hashim, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 299 days.

(21) Appl. No.: 13/697,913

(22) PCT Filed: Jul. 16, 2010

(86) PCT No.: PCT/JP2010/062088

§ 371 (c)(1),
(2), (4) Date: Nov. 14, 2012

(87) PCT Pub. No.: WO2012/008048

PCT Pub. Date: Jan. 19, 2012

(65) Prior Publication Data

US 2013/0118431 A1 May 16, 2013

(51) Int. Cl.

| | |
|---|---|
| ***F02N 15/02*** | (2006.01) |
| ***F02N 11/08*** | (2006.01) |
| *F02N 15/00* | (2006.01) |
| *F02N 15/06* | (2006.01) |

(52) U.S. Cl.

CPC ..... *F02N 11/0851* (2013.01); *F02N 11/0855* (2013.01); *F02N 15/00* (2013.01); *F02N 11/087* (2013.01); *F02N 15/067* (2013.01); *F02N 2011/0888* (2013.01); *F02N 2200/022* (2013.01); *F02N 2200/043* (2013.01); *F02N 2200/063* (2013.01); *F02N 2200/101* (2013.01); *F02N 2200/102* (2013.01)

(58) Field of Classification Search

CPC ..... F02N 15/067; F02N 11/087; F02N 2200/022; F02N 11/0851

USPC ..... 123/179.3, 179.5, 179.1; 701/113, 112

See application file for complete search history.

(56) References Cited

U.S. PATENT DOCUMENTS

| | | | | |
|---|---|---|---|---|
| 2006/0097577 | A1* | 5/2006 | Kato et al. | 307/10.1 |
| 2006/0181084 | A1 | 8/2006 | Albertson et al. | |
| 2010/0050970 | A1 | 3/2010 | Okumoto et al. | |
| 2010/0090526 | A1* | 4/2010 | Itou | 307/10.6 |
| 2010/0299053 | A1* | 11/2010 | Okumoto et al. | 701/113 |

FOREIGN PATENT DOCUMENTS

| | | | |
|---|---|---|---|
| CN | 1821569 | A | 8/2006 |
| EP | 2 159 410 | A2 | 3/2010 |
| EP | 2 514 960 | A1 | 10/2012 |
| JP | A-2005-330813 | | 12/2005 |
| WO | WO 2012/008050 | A1 | 1/2012 |

* cited by examiner

*Primary Examiner* — Mahmoud Gimie
(74) *Attorney, Agent, or Firm* — Oliff PLC

(57) ABSTRACT

A starter includes a pinion gear, an actuator for moving the pinion gear to a position where the pinion gear is engaged with a ring gear in a driven state, and a motor for rotating the pinion gear. An ECU includes a rotation mode in which the motor is driven before the actuator is driven and an engagement mode in which the actuator is driven before the motor is driven. In the engagement mode, the actuator is driven after lapse of a predetermined first time period since a decision to start an engine was made, and the motor is driven after lapse of a second time period longer than the first time period since the decision to start the engine was made. In the rotation mode, the motor is driven after lapse of the second time period since a decision to start the engine was made.

20 Claims, 5 Drawing Sheets

STARTER CONTROL DEVICE, STARTER CONTROL METHOD, AND ENGINE STARTING DEVICE

TECHNICAL FIELD

The present invention relates to a starter control device, a starter control method, and an engine starting device, and particularly to a starter control technique with which an actuator for moving a pinion gear so as to be engaged with a ring gear provided around an outer circumference of a flywheel or a drive plate of an engine and a motor for rotating the pinion gear are individually controlled.

BACKGROUND ART

In recent years, in order to improve fuel efficiency or reduce exhaust emission, some cars having an internal combustion engine such as an engine include what is called an idling-stop function, in which an engine is automatically stopped while a vehicle stops and a driver operates a brake pedal, and the vehicle is automatically re-started, for example, by a driver's operation for re-start such as decrease in an amount of operation of a brake pedal to zero.

In this idling-stop, the engine may be re-started while an engine speed is relatively high. In such a case, with a conventional starter in which pushing-out of a pinion gear for rotating the engine and rotation of the pinion gear are caused by one drive command, the starter is driven after waiting until the engine speed sufficiently lowers, in order to facilitate engagement between the pinion gear and a ring gear of the engine. Then, a time lag is caused between issuance of a request to re-start an engine and actual engine cranking, and the driver may feel uncomfortable.

In order to solve such a problem, Japanese Patent Laying-Open No. 2005-330813 (PTL 1) discloses a technique, with the use of a starter configured such that a pinion gear engagement operation and a pinion gear rotational operation can individually be performed, for causing a pinion gear to perform a rotational operation prior to the pinion gear engagement operation when a re-start request is issued while rotation of an engine is being lowered immediately after a stop request is generated, and for re-starting the engine by performing the pinion gear engagement operation when a pinion gear rotation speed is in synchronization with an engine speed.

CITATION LIST

Patent Literature

PTL 1: Japanese Patent Laying-Open No. 2005-330813

SUMMARY OF INVENTION

Technical Problem

If whether to rotate the pinion gear prior to movement thereof or to move the pinion gear prior to rotation thereof is determined in accordance with an engine speed as in the technique described in Japanese Patent Laying-Open No. 2005-330813, however, a time period from the time point when a condition for re-start of the engine is satisfied until the motor is driven for cranking the engine may vary. Therefore, it is difficult to predict the timing when a voltage of an auxiliary machinery battery temporarily lowers due to cranking. Consequently, for example, up-conversion by a DC/DC converter for maintaining a voltage to be supplied to auxiliary machinery other than the starter, an ECU (Electronic Control Unit), and the like may not be in time.

The present invention was made to solve the above-described problems, and an object of the present invention is to suppress variation in timing when a motor is driven.

Solution to Problem

A control device for a starter including a second gear that can be engaged with a first gear coupled to a crankshaft of an engine, an actuator that moves, in a driven state, the second gear to a position where the second gear is engaged with the first gear, and a motor that rotates the second gear is capable of individually driving each of the actuator and the motor, and it includes a first mode in which the motor is driven before the actuator is driven, a second mode in which the second gear is engaged with the first gear by the actuator before the motor is driven, and determination means for determining whether to start the engine or not. In the second mode, the actuator is driven after lapse of a predetermined first time period since a decision to start the engine was made, and the motor is driven after lapse of a second time period longer than the first time period since the decision to start the engine was made. In the first mode, the motor is driven after lapse of the second time period since the decision to start the engine was made.

A method of controlling a starter including a second gear that can be engaged with a first gear coupled to a crankshaft of an engine, an actuator that moves, in a driven state, the second gear to a position where the second gear is engaged with the first gear, and a motor that rotates the second gear, each of the actuator and the motor being able to individually be driven, includes the steps of driving the actuator and the motor in a first mode in which the motor is driven prior to drive of the actuator, driving the actuator and the motor in a second mode in which the second gear is engaged with the first gear by the actuator before the motor is driven, and determining whether to start the engine or not. In the second mode, the actuator is driven after lapse of a predetermined first time period since a decision to start the engine was made, and the motor is driven after lapse of a second time period longer than the first time period since the decision to start the engine was made. In the first mode; the motor is driven after lapse of the second time period since a decision to start the engine was made.

An engine starting device includes a starter including a second gear that can be engaged with a first gear coupled to a crankshaft of an engine, an actuator that moves, in a driven state, the second gear to a position where the second gear is engaged with the first gear, and a motor that rotates the second gear, and a control unit being capable of individually driving each of the actuator and the motor, including a first mode in which the motor is driven before the actuator is driven and a second mode in which the second gear is engaged with the first gear by the actuator before the motor is driven, and determining whether to start the engine or not. In the second mode, the actuator is driven after lapse of a predetermined first time period since a decision to start the engine was made, and the motor is driven after lapse of a second time period longer than the first time period since the decision to start the engine was made. In the first mode, the motor is driven after lapse of the second time period since a decision to start the engine was made.

Advantageous Effects of Invention

In both modes of the first mode in which the motor is driven before the actuator is driven and the second mode in which the actuator is driven before the motor is driven, the motor is driven after lapse of the second time period since a decision to start the engine was made. Therefore, the timing when the motor is driven can substantially be fixed. Consequently, variation in timing when the motor is driven can be suppressed.

DESCRIPTION OF EMBODIMENTS

Figure 1:
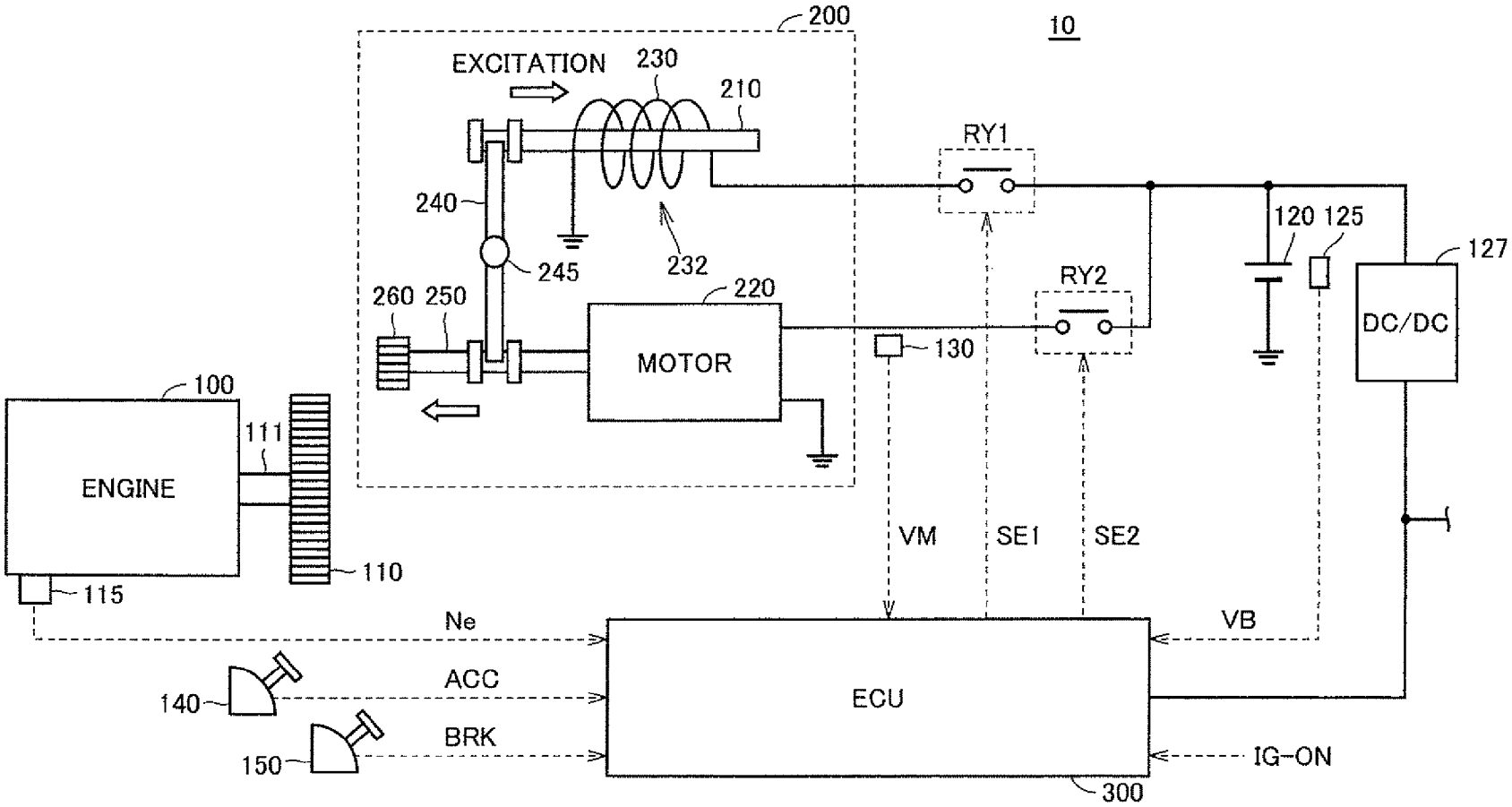
FIG. 1 is an overall block diagram of a vehicle.

An embodiment of the present invention will be described hereinafter with reference to the drawings. In the description below, the same elements have the same reference characters allotted. Their label and function are also identical. Therefore, detailed description thereof will not be repeated.

[Structure of Engine Starting Device]

FIG. 1 is an overall block diagram of a vehicle 10. Referring to FIG. 1, vehicle 10 includes an engine 100, a battery 120, a starter 200, a control device (hereinafter also referred to as an ECU) 300, and relays RY1, RY2. Starter 200 includes a plunger 210, a motor 220, a solenoid 230, a coupling portion 240, an output member 250, and a pinion gear 260.

Engine 100 generates driving force for running vehicle 10. A crankshaft 111 of engine 100 is connected to a drive wheel, with a powertrain structured to include a clutch, a reduction gear, or the like being interposed.

Engine 100 is provided with a rotation speed sensor 115. Rotation speed sensor 115 detects a speed Ne of engine 100 and outputs a detection result to ECU 300.

Battery 120 is an electric power storage element configured such that it can be charged and can discharge. Battery 120 is configured to include a secondary battery such as a lithium ion battery, a nickel metal hydride battery, a lead-acid battery, or the like. Alternatively, battery 120 may be implemented by a power storage element such as an electric double layer capacitor.

Battery 120 is connected to starter 200 with relays RY1, RY2 controlled by ECU 300 being interposed. Battery 120 supplies a supply voltage for driving to starter 200 as relays RY1, RY2 are closed. It is noted that a negative electrode of battery 120 is connected to a body earth of vehicle 10.

Battery 120 is provided with a voltage sensor 125. Voltage sensor 125 detects an output voltage VB of battery 120 and outputs a detection value to ECU 300.

A voltage of battery 120 is supplied to ECU 300 and such auxiliary machinery as an inverter of an air-conditioning apparatus through a DC/DC converter 127. DC/DC converter 127 is controlled by ECU 300 so as to maintain a voltage supplied to ECU 300 and the like. For example, in view of the fact that a voltage of battery 120 temporarily lowers as motor 220 is driven and engine 100 is cranked, the DC/DC converter is controlled to carry out up-conversion when motor 220 is driven.

As will be described later, motor 200 is controlled to be driven after lapse of a predetermined second time period ΔT2 since output of a signal requesting start of engine 100. Therefore, DC/DC converter 127 is controlled to start up-conversion when the signal requesting start of engine 100 is output and to complete up-conversion by the time when predetermined second time period ΔT2 elapses. A method of controlling DC/DC converter 127 is not limited as such.

Relay RY1 has one end connected to a positive electrode of battery 120 and the other end connected to one end of solenoid 230 within starter 200. Relay RY1 is controlled by a control signal SE1 from ECU 300 so as to switch between supply and cut-off of a supply voltage from battery 120 to solenoid 230.

Relay RY2 has one end connected to the positive electrode of battery 120 and the other end connected to motor 220 within starter 200. Relay RY2 is controlled by a control signal SE2 from ECU. 300 so as to switch between supply and cut-off of a supply voltage from battery 120 to motor 220. In addition, a voltage sensor 130 is provided in a power line connecting relay RY2 and motor 220 to each other. Voltage sensor 130 detects a motor voltage VM and outputs a detection value to ECU 300.

As described above, supply of a supply voltage to motor 220 and solenoid 230 within starter 200 can independently be controlled by relays RY1, RY2.

Output member 250 is coupled to a rotation shaft of a rotor (not shown) within the motor, for example, by a straight spline or the like. In addition, pinion gear 260 is provided on an end portion of output member 250 opposite to motor 220. As relay RY2 is closed, the supply voltage is supplied from battery 120 so as to rotate motor 220. Then, output member 250 transmits the rotational operation of the rotor to pinion gear 260, to thereby rotate pinion gear 260.

As described above, solenoid 230 has one end connected to relay RY1 and the other end connected to the body earth. As relay RY1 is closed and solenoid 230 is excited, solenoid 230 attracts plunger 210 in a direction of an arrow. Namely, plunger 210 and solenoid 230 constitute an actuator 232.

Plunger 210 is coupled to output member 250 with coupling portion 240 being interposed. As solenoid 230 is excited, plunger 210 is attracted in the direction of the arrow. Thus, coupling portion 240 of which fulcrum 245 is fixed moves output member 250 from a stand-by position shown in FIG. 1 in a direction reverse to a direction of operation of plunger 210, that is, a direction in which pinion gear 260 moves away from a main body of motor 220. In addition, biasing force reverse to the arrow in FIG. 1 is applied to plunger 210 by a not-shown spring mechanism, and when solenoid 230 is no longer excited, it returns to the stand-by position.

As output member 250 thus operates in an axial direction as a result of excitation of solenoid 230, pinion gear 260 is engaged with ring gear 110 provided around an outer circumference of a flywheel or a drive plate attached to crankshaft 111 of engine 100. Then, as pinion gear 260 performs a rotational operation while pinion gear 260 and ring gear 110 are engaged with each other, engine 100 is cranked and started.

Thus, in the present embodiment, actuator 232 for moving pinion gear 260 so as to be engaged with ring gear 110 provided around the outer circumference of the flywheel or the drive plate of engine 100 and motor 220 for rotating pinion gear 260 are individually controlled.

Though not shown in FIG. 1, a one-way clutch may be provided between output member 250 and a rotor shaft of motor 220 such that the rotor of motor 220 does not rotate due to the rotational operation of ring gear 110.

In addition, actuator 232 in FIG. 1 is not limited to the mechanism as above so long as it is a mechanism capable of transmitting rotation of pinion gear 260 to ring gear 110 and switching between a state that pinion gear 260 and ring gear 110 are engaged with each other and a state that they are not engaged with each other. For example, such a mechanism that pinion gear 260 and ring gear 110 are engaged with each other as a result of movement of the shaft of output member 250 in a radial direction of pinion gear 260 is also applicable.

ECU 300 includes a CPU (Central Processing Unit), a storage device, and an input/output buffer, none of which is shown, and receives input from each sensor or provides output of a control command to each piece of equipment. It is noted that control of these components is not limited to processing by software, and a part thereof may also be constructed by dedicated hardware (electronic circuitry) and processed.

ECU 300 receives a signal ACC indicating an amount of operation of an accelerator pedal 140 from a sensor (not shown) provided on accelerator pedal 140. ECU 300 receives a signal BRK indicating an amount of operation of a brake pedal 150 from a sensor (not shown) provided on brake pedal 150. In addition, ECU 300 receives a start operation signal IG-ON issued in response to a driver's ignition operation or the like. Based on such information, ECU 300 generates a signal requesting start of engine 100 and a signal requesting stop thereof and outputs control signal SE1, SE2 in accordance therewith, so as to control an operation of starter 200.

Figure 2:
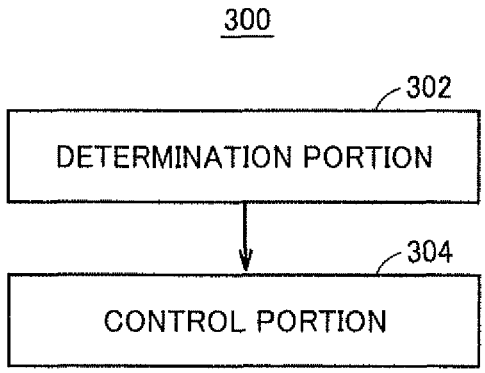
FIG. 2 is a functional block diagram of an ECU.

Referring to FIG. 2, a function of ECU 300 will be described. It is noted that a function of ECU 300 described below may be implemented by software or hardware or by cooperation of software and hardware.

ECU 300 includes a determination portion 302 and a control portion 304. Determination portion 302 determines whether to start engine 100 or not. For example, when an amount of operation of brake pedal 150 by the driver decreases to zero, it is determined that engine 100 is to be started. For example, when an amount of operation of brake pedal 150 by the driver decreases to zero during the course of stopping engine 100 or in a state where engine 100 has been stopped, it is determined that engine 100 is to be started. A method of determining whether to start engine 100 or not is not limited thereto. Other than this method, when accelerator pedal 140, a shift lever for selecting a shift range or a gear, or a switch for selecting a vehicle running mode (for example, a power mode, an eco mode, or the like) is operated, a decision to start engine 100 is made. When a decision to start engine 100 is made, ECU 300 generates and outputs a signal requesting start of engine 100.

When a signal requesting start of engine 100 is output, that is, when a decision to start engine 100 is made, control portion 304 controls actuator 232 and motor 220 in any one mode of a first mode in which actuator 232 and motor 220 are controlled such that pinion gear 260 starts to rotate after pinion gear 260 moved toward ring gear 110 and a second mode in which actuator 232 and motor 220 are controlled such that pinion gear 260 moves toward ring gear 110 after pinion gear 260 started to rotate.

In the first mode, actuator 232 is driven such that pinion gear 260 moves toward ring gear 110 after lapse of a predetermined first time period ΔT1 since a decision to start engine 100 was made, and motor 220 is driven such that pinion gear 260 rotates after lapse of the second time period longer than the first time period since the decision to start engine 100 was made.

In the second mode, after lapse of the second time period since a decision to start engine 100 was made, motor 220 is driven such that pinion gear 260 starts to rotate and actuator 232 is driven such that pinion gear 260 moves toward ring gear 110 after pinion gear started to rotate.

When engine speed Ne is equal to or lower than a predetermined first reference value α1, control portion 304 controls actuator 232 and motor 220 in the first mode. When engine speed Ne is higher than first reference value α1, control portion 304 controls actuator 232 and motor 220 in the second mode.

[Description of Operation Mode of Starter]

Figure 3:
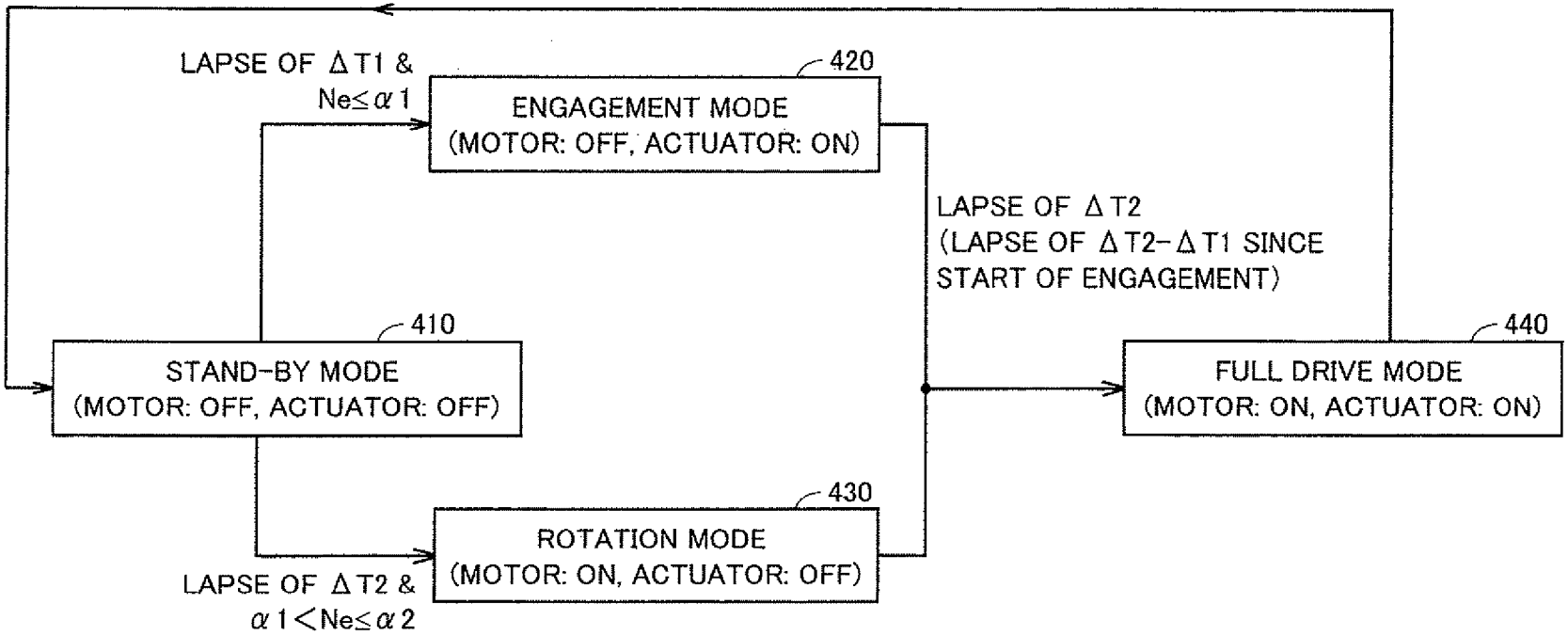
FIG. 3 is a diagram for illustrating transition of an operation mode of a starter.

FIG. 3 is a diagram for illustrating transition of an operation mode of starter 200 in the present embodiment. The operation mode of starter 200 in the present embodiment includes a stand-by mode 410, an engagement mode 420, a rotation mode 430, and a full drive mode 440.

The first mode described previously is a mode in which transition to full drive mode 440 is made via engagement mode 420. The second mode is a mode in which transition to full drive mode 440 is made via rotation mode 430.

Stand-by mode 410 represents such a state that neither of actuator 232 and motor 220 in starter 200 is driven, that is, a state that an engine start request to starter 200 is not output. Stand-by mode 410 corresponds to the initial state of starter 200, and it is selected when drive of starter 200 is not necessary, for example, before an operation to start engine 100, after completion of start of engine 100, failure in starting engine 100, and the like.

Full drive mode 440 represents such a state that both of actuator 232 and motor 220 in starter 200 are driven. In this full drive mode 440, motor 220 rotates pinion gear 260 while pinion gear 260 and ring gear 110 are engaged with each other. Thus, engine 100 is actually cranked and the operation for start is started.

As described above, starter 200 in the present embodiment can independently drive each of actuator 232 and motor 220. Therefore, in a process of transition from stand-by mode 410 to full drive mode 440, there are a case where actuator 232 is driven prior to drive of motor 220 (that is, corresponding to engagement mode 420) and a case where motor 220 is driven prior to drive of actuator 232 (that is, corresponding to rotation mode 430).

Selection between these engagement mode 420 and rotation mode 430 is basically made based on speed Ne of engine 100 when re-start of engine 100 is requested.

Engagement mode 420 refers to a state where only actuator 232 is driven and motor 220 is not driven. This mode is selected when pinion gear 260 and ring gear 110 can be engaged with each other even while pinion gear 260 remains stopped. Specifically, while engine 100 remains stopped or while speed Ne of engine 100 is sufficiently low (Ne≤first reference value α1), this engagement mode 420 is selected.

After lapse of predetermined first time period ΔT1 since generation of a signal requesting start of engine 100, actuator 232 and, motor 220 are controlled in engagement mode 420.

After lapse of second time period ΔT2 longer than first time period ΔT1 since generation of the signal requesting start of engine 100, the operation mode makes transition from engagement mode 420 to full drive mode 440, Namely, actuator 232 and motor 220 are controlled in full drive mode 440.

Difference between first time period ΔT1 and second time period ΔT2 (ΔT2−ΔT1) is set by an engineer as a time period necessary for completion of engagement between pinion gear 260 and ring gear 110. Namely, in the present embodiment, based on lapse of a predetermined period of time since start of drive of actuator 232, it is determined that engagement of pinion gear 260 and ring gear 110 with each other has been completed.

Meanwhile, rotation mode 430 refers to a state where only motor 220 is driven and actuator 232 is not driven. This mode is selected, for example, when a request for re-start of engine 100 is output immediately after stop of engine 100 is requested and when speed Ne of engine 100 is relatively high ($\alpha 1 < Ne \leq$ a second reference value $\alpha 2$).

After lapse of second time period $\Delta T2$ since generation of the signal requesting start of engine 100, actuator 232 and motor 220 are controlled in rotation mode 430.

Thus, when speed Ne of engine 100 is high, difference in speed between pinion gear 260 and ring gear 110 is great while pinion gear 260 remains stopped, and engagement between pinion gear 260 and ring gear 110 may become difficult. Therefore, in rotation mode 430, only motor 220 is driven prior to drive of actuator 232, so that a rotation speed of ring gear 110 and a rotation speed of pinion gear 260 are in synchronization with each other. Then, in response to difference between the rotation speed of ring gear 110 and the rotation speed of pinion gear 260 being sufficiently small, actuator 232 is driven and ring gear 110 and pinion gear 260 are engaged with each other. Then, the operation mode makes transition from rotation mode 430 to full drive mode 440.

In the case of full drive mode 440, the operation mode returns from full drive mode 440 to stand-by mode 410 in response to completion of start of engine 100 and start of a self-sustained operation of engine 100.

Thus, when a signal requesting start of engine 100 is output, that is, when it is determined that engine 100 is to be started, actuator 232 and motor 220 are controlled in any one mode of the first mode in which transition to full drive mode 440 is made via engagement mode 420 and the second mode in which transition to full drive mode 440 is made via rotation mode 430.

Figure 4:
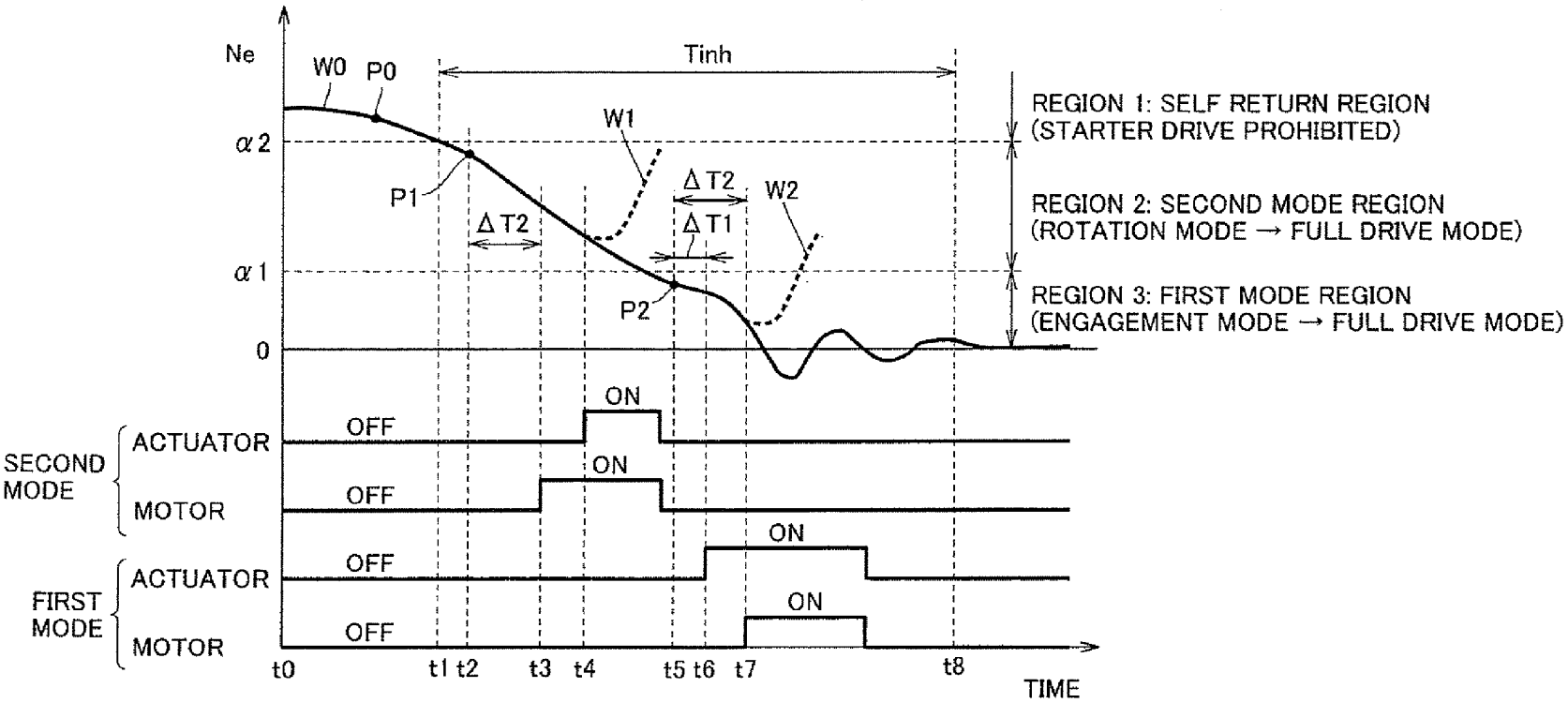
FIG. 4 is a diagram for illustrating a drive mode in an engine start operation.

FIG. 4 is a diagram for illustrating two drive modes (the first mode, the second mode) in an engine start operation in the present embodiment.

In FIG. 4, the abscissa indicates time and the ordinate indicates speed Ne of engine 100 and a state of drive of actuator 232 and motor 220 in the first mode and the second mode.

A case where, at a time t0, for example, a condition that the vehicle stops and the driver operates brake pedal 150 is satisfied and consequently a request to stop engine 100 is generated and combustion in engine 100 is stopped is considered. Here, unless engine 100 is re-started, speed Ne of engine 100 gradually lowers as shown with a solid curve W0 and finally rotation of engine 100 stops.

Then, a case where, for example, an amount of the driver's operation of brake pedal 150 attains to zero while speed Ne of engine 100 is lowering, and thus a request to re-start engine 100 is generated is considered. Here, categorization into three regions based on speed Ne of engine 100 is made.

A first region (region 1) refers to a case where speed Ne of engine 100 is higher than second reference value $\alpha 2$, and for example, such a state that a request for re-start is generated at a point P0 in FIG. 4.

This region 1 is a region where engine 100 can be started by a fuel injection and ignition operation without using starter 200 because speed Ne of engine 100 is sufficiently high. Namely, region 1 is a region where engine 100 can return by itself. Therefore, in region 1, drive of starter 200 is prohibited. It is noted that second reference value $\alpha 2$ described above may be restricted depending on a maximum speed of motor 220.

A second region (region 2) refers to a case where speed Ne of engine 100 is located between first reference value $\alpha 1$ and second reference value $\alpha 2$, and such a state that a request for re-start is generated at a point P1 in FIG. 4.

This region 2 is a region where speed Ne of engine 100 is relatively high, although engine 100 cannot return by itself. In this region, the rotation mode is selected as described with reference to FIG. 3.

When a request to re-start engine 100 is generated at a time t2, initially, motor 220 is driven after lapse of second time period $\Delta T2$. Thus, pinion gear 260 starts to rotate. Then, at a time t4, actuator 232 is driven. When ring gear 110 and pinion gear 260 are engaged with each other, engine 100 is cranked and speed Ne of engine 100 increases as shown with a dashed curve W1. Thereafter, when engine 100 resumes the self-sustained operation, drive of actuator 232 and motor 220 is stopped.

A third region (region 3) refers to a case where speed Ne of engine 100 is lower than first reference value al, and for example, such a state that a request for re-start is generated at a point P2 in FIG. 4.

This region 3 is a region where speed Ne of engine 100 is low and pinion gear 260 and ring gear 110 can be engaged with each other without synchronizing pinion gear 260. In this region, the engagement mode is selected as described with reference to FIG. 3.

When a request to re-start engine 100 is generated at a time t5, initially, actuator 232 is driven after lapse of first time period $\Delta T1$. Thus, pinion gear 260 is pushed toward ring gear 110. Motor 220 is driven after lapse of second time period $\Delta T2$ (a time t7 in FIG. 4). Thus, engine 100 is cranked and speed Ne of engine 100 increases as shown with, a dashed curve W2. Thereafter, when engine 100 resumes the self-sustained operation, drive of actuator 232 and motor 220 is stopped.

By thus controlling re-start of engine 100 by using starter 200 in which actuator 232 and motor 220 can independently be driven, engine 100 can be re-started in a shorter period of time than in a case of a conventional starter where an operation to re-start engine 100 was prohibited during a period (Tinh) from a speed at which return of engine 100 by itself was impossible (a time t1 in FIG. 4) to stop of engine 100 (a time t8 in FIG. 4). Thus, the driver's uncomfortable feeling due to delayed re-start of the engine can be lessened.

[Description of Operation Mode Setting Control]

Figure 5:
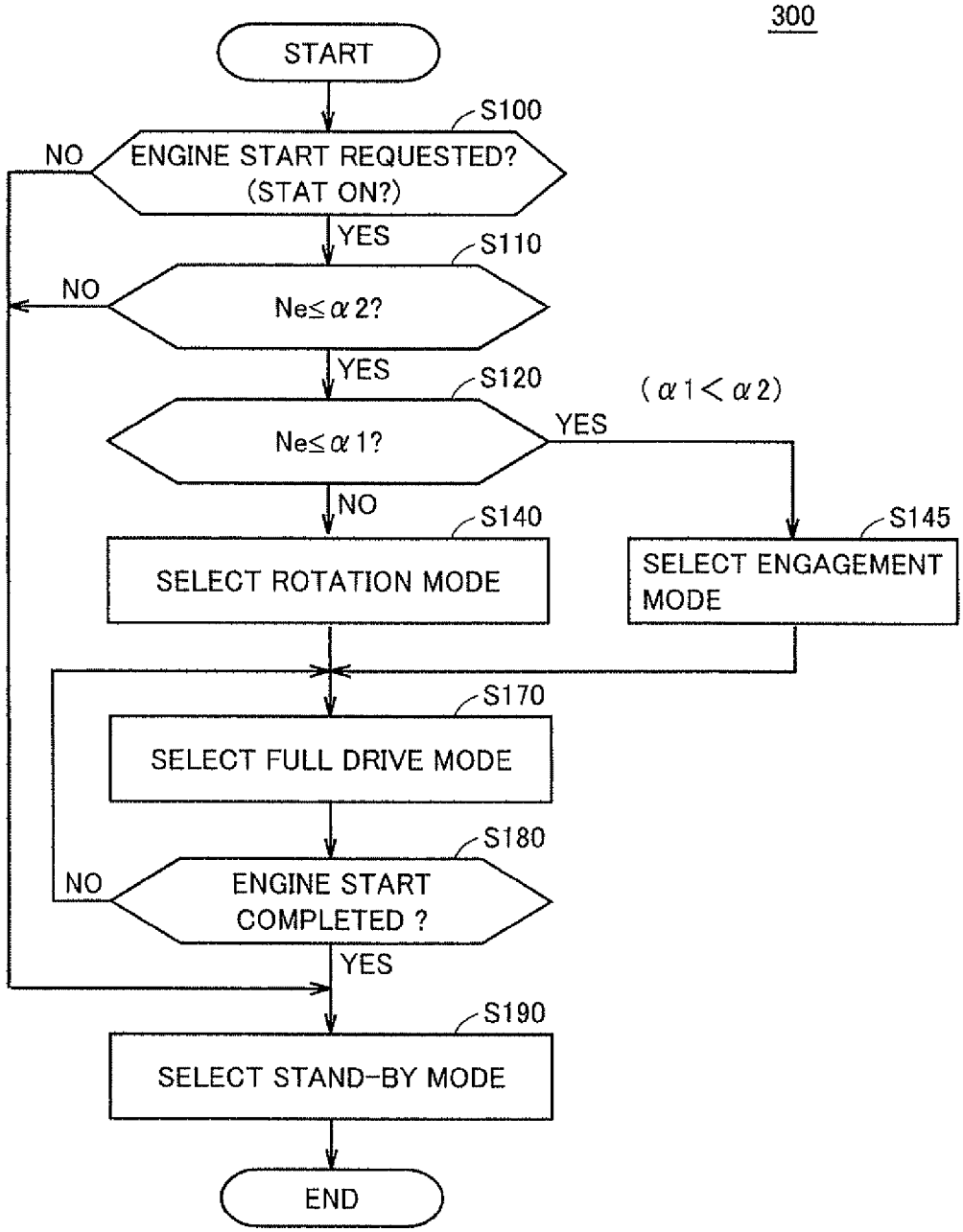
FIG. 5 is a flowchart showing a control structure of processing performed by the ECU.

FIG. 5 is a flowchart for illustrating details of operation mode setting control processing performed by ECU 300 in the present embodiment. The flowchart shown in FIG. 5 is realized by executing a program stored in advance in ECU 300 in a prescribed cycle. Alternatively, regarding some steps, processing can also be performed by constructing dedicated hardware (electronic circuitry).

Referring to FIGS. 1 and 5, in step (hereinafter the step being abbreviated as S) 100, ECU 300 determines whether start of engine 100 has been requested or not. That is, whether to start engine 100 or not is determined.

When start of engine 100 has not been requested (NO in S100), ECU 300 causes the process to proceed to S190 and selects the stand-by mode because an operation to start engine 100 is not necessary.

When start of engine 100 has been requested (YES in S100), the process proceeds to S110 and ECU 300 then determines whether or not speed Ne of engine 100 is equal to or lower than second reference value $\alpha 2$.

When speed Ne of engine 100 is higher than second reference value $\alpha 2$ (NO in S110), this case corresponds to region 1 in FIG. 4 where engine 100 can return by itself. Therefore, ECU 300 causes the process to proceed to S190 and selects the stand-by mode.

When speed Ne of engine 100 is equal to or lower than second reference value $\alpha 2$ (YES in S110), ECU 300 further determines whether or not speed Ne of engine 100 is equal to or lower than first reference value α1.

When speed Ne of engine 100 is equal to or lower than first reference value α1 (YES in S120), this case corresponds to region 1 in FIG. 4. Therefore, the process proceeds to S145 and ECU 300 selects the engagement mode. Then, ECU 300 outputs control signal SE so as to close relay RY1, and thus actuator 232 is driven. Here, motor 220 is not driven.

Thereafter, the process proceeds to S170 and ECU 300 selects the full drive mode. Then, starter 200 starts cranking of engine 100.

Then, in S180, ECU 300 determines whether start of engine 100 has been completed or not. Determination of completion of start of engine 100 may be made, for example, based on whether or not the engine speed is higher than a threshold value γ indicating the self-sustained operation after lapse of a prescribed period of time since start of drive of motor 220.

When start of engine 100 has not been completed (NO in S180), the process returns to S170 and cranking of engine 100 is continued.

When start of engine 100 has been completed (YES in S180), the process proceeds to S190 and ECU 300 selects the stand-by mode.

On the other hand, when speed Ne of engine 100 is higher than first reference value α1 (NO in S120), the process proceeds to S140 and ECU 300 selects the rotation mode. Then, ECU 300 outputs control signal SE2 so as to close relay RY2, and thus motor 220 is driven. Here, actuator 232 is not driven.

Then, ECU 300 selects the full drive mode in S170. Thus, actuator 232 is driven, pinion gear 260 and ring gear 110 are engaged with each other, and engine 100 is cranked.

As described above, in the present embodiment, in both modes of the first mode in which actuator 232 and motor 220 are controlled such that pinion gear 260 starts to rotate after pinion gear 260 moved toward ring gear 110 and the second mode in which actuator 232 and motor 220 are controlled such that pinion gear 260 moves toward ring gear 110 after pinion gear 260 started to rotate, motor 220 is driven after lapse of second time period ΔT2 since a decision to start engine 100 was made. Therefore, the timing when motor 220 is driven can substantially be fixed. Consequently, variation in timing when motor 220 is driven can be suppressed.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

REFERENCE SIGNS LIST

10 vehicle; 100 engine; 110 ring gear; 111 crankshaft; 115 rotation speed sensor; 120 battery; 125, 130 voltage sensor; 140 accelerator pedal; 150 brake pedal; 160 powertrain; 170 drive wheel; 200 starter; 210 plunger; 220 motor; 230 solenoid; 232 actuator; 240 coupling portion; 245 fulcrum; 250 output member; 260 pinion gear; 300 ECU; 302 determination portion; 304 control portion; 410 stand-by mode; 420 engagement mode; 430 rotation mode; 440 full drive mode; and RY1, RY2 relay.

The invention claimed is:

1. A control device for a starter, said starter including a second gear engageable with a first gear coupled to a crankshaft of an engine, an actuator that moves, in a driven state, said second gear to a position where said second gear is engaged with said first gear, and a motor that rotates said second gear, said control device being configured to individually drive each of said actuator and said motor, the control device comprising:

a first mode in which said second gear is engaged with said first gear by said actuator before said motor is driven;

a second mode in which said motor is driven before said actuator is driven; and determination means for determining whether to start said engine, wherein in said first mode, said actuator is driven at a first time after lapse of a predetermined first time period since a decision to start said engine was made, and said motor is driven at a second time after lapse of a second time period since the decision to start said engine was made, the second time occurring later than said first time relative to a time at which the decision to start said engine was made, and in said second mode, said motor is driven at the second time after lapse of said second time period since the decision to start said engine was made.

2. The control device for a starter according to claim 1, wherein when a speed of said engine is equal to or lower than a predetermined speed, said actuator and said motor are driven in said first mode, and when a speed of said engine is higher than said predetermined speed, said actuator and said motor are driven in said second mode.

3. The control device for a starter according to claim 1, wherein said engine is mounted on a vehicle, and said determination means determines whether to start said engine based on a driver's operation.

4. A method of controlling a starter, said starter including a second gear the engageable with a first gear coupled to a crankshaft of an engine, an actuator that moves, in a driven state, said second gear to a position where said second gear is engaged with said first gear, and a motor that rotates said second gear, each of said actuator and said motor being individually driveable, the method comprising:

driving said actuator and said motor in a first mode in which said second gear is engaged with said first gear by said actuator before said motor is driven;

driving said actuator and said motor in a second mode in which said motor is driven prior to drive of said actuator; and determining whether to start said engine, wherein in said first mode, said actuator is driven at a first time after lapse of a predetermined first time period since a decision to start said engine was made, and said motor is driven at a second time after lapse of a second time period since the decision to start said engine was made, the second time occurring later than said first time relative to a time at which the decision to start said engine was made, and in said second mode, said motor is driven at the second time after lapse of said second time period since the decision to start said engine was made.

5. The method of controlling a starter according to claim 4, wherein when a speed of said engine is equal to or lower than a predetermined speed, said actuator and said motor are driven in said first mode, and when a speed of said engine is higher than said predetermined speed, said actuator and said motor are driven in said second mode.

6. The method of controlling a starter according to claim 4, wherein said engine is mounted on a vehicle, and said step of determining whether to start said engine includes the step of determining whether to start said engine based on a driver's operation.

7. An engine starting device, comprising:

a starter including a second gear engageable with a first gear coupled to a crankshaft of an engine, an actuator that moves, in a driven state, said second gear to a position where said second gear is engaged with said first gear, and a motor that rotates said second gear; and a control unit configured to individually drive each of said actuator and said motor, including a first mode in which said second gear is engaged with said first gear by said actuator before said motor is driven and a second mode in which said motor is driven before said actuator is driven, and determine whether to start said engine, wherein in said first mode, said actuator is driven at a first time after lapse of a predetermined first time period since a decision to start said engine was made, and said motor is driven at a second time after lapse of a second time period since the decision to start said engine was made, the second time occurring later than said first time relative to a time at which the decision to start said engine was made, and in said second mode, said motor is driven at the second time after lapse of said second time period since the decision to start said engine was made.

8. A control device for a starter, said starter including a second gear engageable with a first gear coupled to a crankshaft of an engine, an actuator that moves, in a driven state, said second gear to a position where said second gear is engaged with said first gear, and a motor that rotates said second gear with electric power supplied from a battery through a converter carrying out up-conversion, the control device being configured to:

individually drive each of said actuator and said motor in one of two modes, the two modes including a first mode in which said motor is driven after said actuator is driven and a second mode in which said actuator is driven after said motor is driven;

start controlling said converter to carry out up-conversion when the engine is requested to start; and start driving said motor after said converter completes up-conversion.

9. The control device for a starter according to claim 8, wherein when a speed of said engine is equal to or lower than a predetermined speed, said actuator and said motor are driven in said first mode, and when a speed of said engine is higher than said predetermined speed, said actuator and said motor are driven in said fir second mode.

10. A method of controlling a starter, said starter including a second gear engageable with a first gear coupled to a crankshaft of an engine, an actuator that moves, in a driven state, said second gear to a position where said second gear is engaged with said first gear, and a motor that rotates said second gear with electric power supplied from a battery through a converter carrying out up-conversion, each of said actuator and said motor being individually driveable, the method comprising:

driving said actuator and said motor in a first mode in which said motor is driven after said actuator is driven;

driving said actuator and said motor in a second mode in which said actuator is driven after said motor is driven;

starting controlling said converter to carry out up-conversion when the engine is requested to start; and starting driving said motor after said converter completes up-conversion.

11. The method of controlling a starter according to claim 10, wherein when a speed of said engine is equal to or lower than a predetermined speed, said actuator and said motor are driven in said first mode, and when a speed of said engine is higher than said predetermined speed, said actuator and said motor are driven in said second mode.

12. An engine starting device, comprising:

a starter including a second gear engageable with a first gear coupled to a crankshaft of an engine, an actuator that moves, in a driven state, said second gear to a position where said second gear is engaged with said first gear, and a motor that rotates said second gear with electric power supplied from a battery through a converter carrying out up-conversion; and a control unit configured to individually drive each of said actuator and said motor in one of two modes, the two modes including a first mode in which said motor is driven after said actuator is driven and a second mode in which said actuator is driven after said motor is driven, start controlling said converter to carry out up-conversion when the engine is requested to start; and start driving said motor after said converter completes up-conversion.

13. The engine starting device according to claim 12, wherein said control unit configured to drive said actuator and said motor in said first mode when a speed of said engine is equal to or lower than a predetermined speed, and drive said actuator and said motor in said second mode when a speed of said engine is higher that said predetermined speed.

14. The control device for a starter according to claim 13, wherein when a speed of said engine is equal to or lower than a predetermined speed, said actuator and said motor are driven in said first mode, and when a speed of said engine is higher than said predetermined speed, said actuator and said motor are driven in said fir second mode.

15. A control device for a starter, said starter including a second gear engageable with a first gear coupled to a crankshaft of an engine, an actuator that moves, in a driven state, said second gear to a position where said second gear is engaged with said first gear, and a motor that rotates said second gear with electric power supplied from a battery through a converter controlled to carry out up-conversion as result of a request to start the engine, and said control device being configured to:

select a mode from a first mode in which said motor is driven after said actuator is driven and a second mode in which said actuator is driven after said motor is driven; and perform the selected mode, wherein an interval from a request to start the engine to a beginning of driving said motor in said first mode is equal to an interval from a request to start the engine to a beginning of driving said motor in said second mode.

16. The control device for a starter according to claim 15, wherein when a speed of said engine is equal to or lower than a predetermined speed, said actuator and said motor are driven in said first mode, and when a speed of said engine is higher than said predetermined speed, said actuator and said motor are driven in said second mode.

17. A method of controlling a starter, said starter including a second gear engageable with a first gear coupled to a crankshaft of an engine, an actuator that moves, in a driven state, said second gear to a position where said second gear is engaged with said first gear, and a motor that rotates said second gear with electric power supplied from a battery through a converter controlled to carry out up-conversion as result of a request to start the engine, comprising the steps of:

selecting a mode from a first mode in which said motor is driven after said actuator is driven and a second mode in which said actuator is driven after said motor is driven; and performing the selected mode, wherein an interval from a request to start the engine to a beginning of driving said motor in said first mode is equal to an interval from a request to start the engine to a beginning of driving said motor in said second mode.

18. The method of controlling a starter according to claim 17, wherein when a speed of said engine is equal to or lower than a predetermined speed, said actuator and said motor are driven in said first mode, and when a speed of said engine is higher than said predetermined speed, said actuator and said motor are driven in said second mode.

19. An engine starting device, comprising:

a starter including a second gear engageable with a first gear coupled to a crankshaft of an engine, and actuator that moves, in a driven state, said second gear to a position where said second gear is engaged with said first gear, and a motor that rotates said second gear with electric power supplied from a battery through a converter controlled to carry out up-conversion as result of a request to start the engine; and a control unit configured to select a mode from a first mode in which said motor is driven after said actuator is driven and a second mode in which said actuator is driven after said motor is driven; and perform the selected mode, wherein an interval from a request to start the engine to a beginning of driving said motor in said first mode is equal to an interval from a request to start the engine to a beginning of driving said motor in said second mode.

20. The control device for a starter according to claim 19, wherein when a speed of said engine is equal to or lower than a predetermined speed, said actuator and said motor are driven in said first mode, and when a speed of said engine is higher than said predetermined speed, said actuator and said motor are driven in said second mode.

* * * * *